US006652931B1

(12) United States Patent
Otani et al.

(10) Patent No.: US 6,652,931 B1
(45) Date of Patent: Nov. 25, 2003

(54) RECORDING MATERIAL FOR INK-JET RECORDING

(75) Inventors: Teiichi Otani, Tokyo (JP); Atsushi Ono, Tokyo (JP); Noboru Kondo, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 09/820,882

(22) Filed: Mar. 30, 2001

(30) Foreign Application Priority Data

Mar. 30, 2000 (JP) ..... 2000-095723
Mar. 9, 2001 (JP) ..... 2001-066297

(51) Int. Cl.[7] ..... B41M 5/40

(52) U.S. Cl. ..... 428/32.25; 428/32.3; 428/32.34; 428/32.37

(58) Field of Search ..... 428/195, 207, 428/219, 340, 32.25, 32.3, 32.34, 32.37

(56) References Cited

U.S. PATENT DOCUMENTS 5,008,231 A * 4/1991 Yoshizawa et al. ..... 503/207
5,185,213 A * 2/1993 Fujita et al. ..... 428/500
5,443,909 A * 8/1995 Mandoh et al. ..... 428/402.21
5,750,200 A * 5/1998 Ogawa et al. ..... 427/361
5,902,770 A 5/1999 Narita et al.
5,952,104 A * 9/1999 Sugiyama et al. ..... 428/409
5,989,701 A * 11/1999 Goetzen et al. ..... 428/327
6,001,771 A 12/1999 Nakano et al.
6,110,601 A * 8/2000 Shaw-Klein et al. ..... 428/522
6,326,323 B1 * 12/2001 Shimano et al. ..... 442/76
6,372,329 B1 * 4/2002 Graczyk et al. ..... 428/195
6,383,611 B1 * 5/2002 Kohno et al. ..... 428/195
6,410,123 B1 * 6/2002 Otani et al. ..... 428/212
6,436,513 B1 * 8/2002 Kitamura et al. ..... 428/195
6,485,812 B1 * 11/2002 Sekiguchi ..... 428/195

FOREIGN PATENT DOCUMENTS

| | | | |
|---|---|---|---|
| EP | 0543339 | A | 5/1993 |
| EP | 0893274 | A | 1/1999 |
| EP | 0952005 | A | 10/1999 |
| JP | 09169157 | A | 6/1997 |
| WO | 0001534 | A | 1/2000 |

OTHER PUBLICATIONS

English abstract of JP 09169157 A.
English Abstract of WO0001534 A.

* cited by examiner

*Primary Examiner*—Bruce H. Hess
*Assistant Examiner*—B. Shewareged
(74) *Attorney, Agent, or Firm*—Millen, White, Zelano & Branigan, P.C.

(57) ABSTRACT

A recording material for ink-jet recording, having on a support a light resistance-imparting layer containing a light resistance-imparting chemical and an image-forming layer free of a light resistance-imparting chemical, which are provided in the order described.

12 Claims, No Drawings

RECORDING MATERIAL FOR INK-JET RECORDING

FIELD OF THE INVENTION

The present invention relates to a recording material for ink-jet recording. More specifically, the invention is concerned with a recording material which has good ink absorbency and excellent color reproducibility, can provide high-quality images of a photograph style, and can ensure excellent keeping properties, particularly light resistance, in the images printed thereon by an ink-jet printer.

BACKGROUND OF THE INVENTION

Ink-jet recording methods enable full-color printing to be easily achieved with a low noise level. In recent years, therefore, the utilization of ink-jet recording methods has been spreading at a rapid rate. According to such methods, fine drops of ink are jetted from nozzles at a high speed so as to direct toward a recording material. And a large quantity of solvent is contained in the ink used. As a result, recording materials for ink-jet recording are required to absorb ink promptly. The recent years have also seen rapid proliferation of personal computers and digital cameras. Under these circumstances, image qualities on a level similar to those attained by silver salt photography have come to be required for images printed from digital image information. In other words, it has become necessary for recording materials to ensure high-density colors, high resolution and excellent color reproduction in the images printed from digital information.

Moreover, latest improvements in quality of printed images have made the storage stability of recorded images more important. In the ink-jet recording systems employed at present, acid dyes or direct dyes are most commonly used as printing ink because they can avoid clogging a printing head with ink and ensure high saturation in the ink images recorded, but these dyes do not always have satisfactory resistance to water and light.

With the intention of imparting both water resistance and light resistance to printed images, it has been tried to use various compounds in recording layers. For instance, the use of particular cationic resins such as quaternary compounds of polyethyleneimine is disclosed in Japanese Tokkai Sho 59-198188 (the term "Tokkai" as used herein means an "unexamined published patent application"), the use of colloidal cationic silica in Japanese Tokkai Sho 60-260377, the use of hindered amine compounds in Japanese Tokkai Sho 61-146591, and the use of quaternary ammonium salts of polyoxyalkylenated amine monocarboxylic acid esters in Japanese Tokkai Sho 61-284478. However, those compounds have a measure of improving effect on water resistance of images, but their effects produced on improvements of light resistance are still insufficient. As matters now stand, therefore, no compounds capable of ensuring both water resistance and light resistance in printed images are found yet.

For the purpose of enhancing the light resistance in particular, the addition of ultraviolet absorbents and antioxidants to recording layers are disclosed in Japanese Tokkai Sho 57-87988 and Japanese Tokkai Sho 57-87989 respectively. Although it can be recognized that those methods have effects on improvement of light resistance, the improving effects thereof are insufficient for practical use. In addition, it is admitted that those methods cause troubles in printed image quality. More specifically, the former method of adding ultraviolet absorbents causes serious reduction in color reproduction, and fails to provide images of photographic style from the very beginning of printing; while the latter method of adding antioxidants has a defect that the antioxidants themselves turn brown with the lapse of time and thereby a storage stability problem is caused in white areas of the recording paper containing them.

With the current state of the art, therefore, it is unsuccessful to produce recording paper capable of providing images of photograph style, and at the same time, inhibiting the images from deteriorating under exposure to light, water and gases, and further having excellent keeping quality to avoid discoloring in the white area.

SUMMARY OF THE INVENTION

Therefore, an object of the invention is to provide a recording material which can produce images having high densities and excellent color reproduction, or images of the so-called photograph style, when the color printing with an ink-jet printer, particularly a high-resolution ink-jet printer, is done thereon, and ensure excellent keeping quality, especially high resistance to light, in the printed images.

In the cases where improvements in keeping quality of recorded images, inclusive of water resistance and light resistance, have been intended in the field of ink-jet recording as well as various other fields, it has so far been a common-sense way to add keeping quality-improving chemicals to recording layers or provide a protective layer containing such chemicals on the upper side of a recording layer. This is because light and water influence a printed image surface from the outside and cause deterioration of keeping quality in the printed images. However, since the ink-jet recording is a recording method of jetting ink directly to the surface of an ink-receptive layer and forming ink images thereon, it is ineffective to provide a protective layer on the outside of the ink-receiving layer. Further, the coloring materials used in ink are direct dyes or acid dyes. These dyes are superior in coloring properties, but they are subject to cleavage of double bonds in their structures by ultraviolet rays or oxidizing gases and thereby their oxidation is promoted to result in discoloration or fading. In addition, those dyes are liable to be affected by various chemicals. Therefore, the addition of other chemicals to an image-forming layer carries the risk of directly producing adverse effects on coloring properties.

As a result of our intensive studies to resolve the foregoing antinomic problem, to our surprise, it has been found that as far as light resistance-imparting chemicals are added to a layer provided beneath an image-forming layer, but not to the image-forming layer by which ink is directly accepted, they enables significant improvement in light resistance and, at the same time, complete avoidance of their adverse effects on coloring properties of dyes which has so far been a problem to be addressed.

More specifically, the aforementioned problem is resolved by structuring a recording material for ink-jet recording so as to comprise a support coated with a light resistance-imparting layer containing a light resistance-imparting chemical and an image-forming layer free of a light resistance-imparting chemical in the order described.

Further, the foregoing recording material for ink-jet recording can acquire a more suitable balance between ink absorbency and color reproduction of images when the light resistance-imparting layer has a coverage of 5 to 20 g/m$^2$ (on a dry basis) and the image-forming layer has a coverage of 4 to 20 g/m$^2$ (on a dry basis).

Furthermore, the light resistance of the recording material as mentioned above can be greatly increased when the light resistance-imparting chemical contained in the light resistance-imparting layer is at least one chemical selected from inorganic ultraviolet absorbents, organic ultraviolet absorbents, or divalent or higher metal salts, and the content thereof is from 0.5 to 20 parts by weight when it is an inorganic ultraviolet absorbent, from 0.5 to 15 parts when it is an organic ultraviolet absorbent, or from 0.5 to 10 parts by weight when it is a divalent or higher metal salt, per 100 parts by weight of pigments contained in the light resistance-imparting layer.

In addition, the light resistance of the recording material as mentioned above can be further increased when the light resistance-imparting chemical contained in the light resistance-imparting layer is at least one organic ultraviolet absorbent selected from the group consisting of hindered amines, benzotriazoles and benzophenones, or at least one inorganic ultraviolet absorbent selected from the group consisting of zinc oxide, titanium oxide and cerium oxide.

DETAILED DESCRIPTION OF THE INVENTION

The present image-forming layer is a layer mainly functioning so as to accept ink and fix dyes in ink, thereby forming images. This layer may have a composition selected from those known to be effective for ink-receiving layers depending on the image definition intended, but it is critical for the present image-forming layer to be free of light resistance-imparting chemicals. Specifically, the present image-forming layer may be constituted mainly of an ink-receptive pigment having high oil absorbency, a binder suitable for the pigment used, and a cationic high polymer enabling dye fixation and improvement of water resistance.

The present light resistance-imparting layer is a layer mainly functioning so as to absorb an ink vehicle passing through the image-forming layer and fix the vehicle therein. This layer may have various compositions depending on the type of ink used and the recording speed desired. In general, it may contain as main components a highly oil-absorptive pigment and a binder suitable for the pigment used. Moreover, the incorporation of light resistance-imparting chemicals therein forms a salient feature of the invention. The light resistance-imparting chemicals may be incorporated in two ways. In one way, such a chemical is mixed in a coating composition comprising a pigment and a binder, and then coated in a layer. In the other way, the layer formed from a binder and a pigment is coated or impregnated with a coating composition containing a light resistance-imparting chemical as a main component.

The suitable coverage of each of the aforementioned layers varies depending on the type of ink used, the image definition intended, the recording speed intended, and the species and mixing proportions of ingredients constituting each layer. Specifically, the suitable coverage of the present image-forming layer is from 4 to 20 g/m$^2$, preferably from 5 to 15 g/m$^2$, on a dry basis. When the coverage of an image-forming layer is within such a range, the layer can retain a large quantity of ink having a relatively low concentration required for reproducing images of photograph style, and enables a light resistance-imparting chemical to produce its effect when the chemical is incorporated in the light resistance-imparting layer arranged therebeneath. With respect to the present light resistance-imparting layer, the suitable coverage thereof, though depends to some extent on the properties of a base paper used, is from 5 to 25 g/m$^2$, preferably from 7 to 15 g/m$^2$, on a dry basis. When the coverage is below 5 g/m$^2$, the whole ink-receiving layer, inclusive of the image-forming layer, is lacking in absorptive capacity, and causes bleeding. On the other hand, the coverage greater than 25 g/m$^2$ is undesirable because the layer coated has insufficient strength and tends to come off in powder, and besides, it has too high absorbency in the thickness direction and thereby the ink dot size is reduced and tends to cause a banding phenomenon in solid images.

The present light resistance-imparting layer is provided so as to be in direct contact with the image-forming layer. Additionally, the present image-forming and light resistance-imparting layers each may have a multi-layer structure so long as the effects intended by the invention can be produced.

Further, an interlayer containing no light resistance-imparting chemicals and acting mainly as absorbent and fixer of an ink vehicle or functioning so as to improve adhesion between a support and a light resistance-imparting layer can be provided between the light resistance-imparting to layer and the support.

As to the light resistance-imparting chemicals, any compounds may be used in the layer specified by the invention so long as they can impart light resistance to recording materials according to the invention. Typical examples of such chemicals include compounds categorized as inorganic or organic ultraviolet absorbents and salts of divalent or higher metals.

Examples of an inorganic ultraviolet absorbent appropriately used herein include zinc oxide, titanium dioxide and cerium oxide. The suitable proportion of inorganic ultraviolet absorbents in the light resistance-imparting layer is from 0.5 to 20 parts by weight, preferably from 1 to 10 parts by weight, to 100 parts by weight of pigment present therein. When inorganic ultraviolet absorbents are added in a proportion lower than 0.5 parts by weight, they cannot have satisfactory effect on improvement of light resistance; while, when added in a proportion higher than 20 parts by weight, they cause changes in hues of printed images.

Examples of an organic ultraviolet absorbent appropriately used herein include benzotriazole compounds, benzophenone compounds and hindered amine compounds. The suitable proportion of organic ultraviolet absorbents in the light resistance-imparting layer is from 0.5 to 15 parts by weight, preferably from 1 to 12 parts by weight, to 100 parts by weight of pigment present therein. When organic ultraviolet absorbents are added in a proportion lower than 0.5 parts by weight, they also cannot have satisfactory effect on improvement of light resistance; while, when added in a proportion higher than 15 parts by weight, they lower color densities of printed images, and besides, a vain rise in production cost is caused because the light resistance improving effect obtained enters a state called level-off and those chemicals are expensive.

As divalent or higher metal salts, aluminum sulfate, zinc sulfate and copper sulfate are preferred from the handling point of view. The suitable proportion of such metal salts in the light resistance-imparting layer, though varies according to the species thereof (e.g., valence of metal ion) to some extent, is of the order of 0.5 to 10 parts by weight, preferably 0.8 to 6 parts by weight, to 100 parts by weight of pigment present therein. When those metal salts are added in a proportion lower than 0.5 parts by weight, they also cannot have satisfactory effect on improvement of light resistance; while, when added in a proportion higher than 10 parts by weight, there occurs the so-called bronzing phenomenon, or a phenomenon that spots tinged with red are scattered at random over the areas printed in black ink.

In the invention, light resistance-imparting chemicals of different kinds may be used in combination. When the light resistance-imparting layer is made up of two or more constituent layers, light resistance-imparting chemicals of different kinds may be incorporated as a mixture in one constituent layer, or individually in separate constituent layers.

The light-resistant chemicals as recited above are not the same in their actions, but it is generally thought that the organic ultraviolet absorbents mainly absorb light in the ultraviolet region, such as sun's ultraviolet radiation, the inorganic ultraviolet absorbents mainly absorb visible light such as fluorescent light, and the metal salts prevent oxidation of ink. Therefore, the combined use of light resistance-imparting chemicals having different actions can yield a significant improvement in light resistance over the independent use thereof. In the case of such a combined use, the total amount of light-resistant chemicals used is from 0.5 to 30 parts by weight, preferably from 1 to 20 parts by weight, per 100 parts by weight of pigment.

In the invention, it is required for the image-forming layer to be free of those light resistance-imparting chemicals. Additionally, the expression "free of" means that the content of such chemicals in the image-forming layer is not high enough to cause undesirable phenomena mentioned below and those chemicals are not added to a coating composition for forming the image-forming layer. The undesirable phenomena caused are as follows: When metal salts get in the image-forming layer, bronzy luster develops in the areas printed in black ink; while, when inorganic ultraviolet absorbents get in the image-forming layer, changes in hues of printed images, particularly a marked rising in yellow tone, are caused to tint the images yellow in their entirety. And the transparency of the image-forming layer is lowered when they get mixed therein, because the organic ultraviolet absorbents in themselves are low in transparency. As a result, deterioration in color reproduction becomes a problem.

The present recording material has no particular restrictions on a support used therein. Both transparent and opaque supports can be used therein. Examples of a usable support include various plastic films, such as films of cellophane, polyethylene, polypropylene, soft polyvinyl chloride, hard polyvinyl chloride and polyester, and a wide variety of paper including wood-free paper, base paper for photographic paper, drawing paper, painting paper, art paper, coated paper, cast-coated paper, craft paper, impregnated paper and synthetic paper. Depending on the desired purpose, the support for the present recording material can be selected properly from the plastic films or various paper sheets as recited above.

As pigments for the present light resistance-imparting layer and image-forming layer, synthetic amorphous silica is generally used. However, other pigments may also be employed. Examples of usable pigments include alumina, hydrated alumina (e.g., alumina sol, colloidal alumina and psuedo-boehmite), aluminum silicate, magnesium silicate, magnesium carbonate, precipitated calcium carbonate, ground calcium carbonate, kaolin, talc, calcium sulfate, zinc carbonate, calcium silicate aluminum hydroxide and plastic pigments. For attaining the high ink absorbency aimed at and enabling the ink-receiving layer to have its coverage in the range where the layer does not come off in powder, it is appropriate to use a pigment having a rather high oil absorption, specifically an oil absorption of 100 to 300 cc/100 g. When two or more of pigments different in oil absorption are used, it is appropriate to mix them so that the average oil absorption of pigments mixed is in the foregoing range.

The pigment composition of the image-forming layer may be the same as that of the light resistance-imparting layer, but it is preferable that the pigment composition of the image-forming layer be formulated so as to have a little higher average oil absorption than that of the light resistance-imparting layer.

As to the binders for the present light resistance-imparting layer and image-forming layer, there is no particular restriction. Examples of binders usable in those layers include polyvinyl alcohol and modified products thereof, polyvinyl acetate, oxidized starch, etherified starch, casein, gelatin, soybean protein, carboxymethyl cellulose, SB latex, NB latex, acrylic resin latex, ethylene-vinyl acetate copolymer latex, polyurethane and unsaturated polyester resins. Such binders may be used alone or as a mixture of two or more thereof. The suitable amount of binders added, though varies to some extent according to the species of pigments used, is in a specified range of 5 to 60 parts by weight, preferably 10 to 40 parts by weight, per 100 parts by weight of pigment composition as recited above.

When they each contain binders in an amount smaller than 5 parts by weight, the layers have a strength problem irrespective of species of pigments used therein; while, when the amount of binders added is larger than 60 parts by weight, the ink absorptive capacity of the resulting layer becomes insufficient, and thereby bleeding and setoff are apt to occur.

To each of the image-forming layer and light resistance-imparting layer according to the invention, various additives including a pigment-dispersing agent, a thickener, an anti-foaming agent, a defoaming agent, a release agent, a blowing agent, a coloring dye, a coloring pigment, a fluorescent dye, an antiseptic, a waterproof agent, a surfactant and a wet paper strength increasing agent can be added in appropriate amounts, if needed.

For providing the present image-forming layer and light resistance-imparting layer each on a support, general coating apparatus of various kinds, such as a blade coater, a roll coater, an air knife coater, a bar coater, a gate roll coater, a curtain coater, a short dwell coater, a gravure coater, a flexo gravure coater and a size press, can be used under an on-machine or off-machine condition. In addition, a transfer method can also be adopted wherein the light resistance-imparting layer is coated on a support, and on a film other than the support the image-forming layer is coated, and then these coatings are brought into face-to-face contact and bonded together.

Additionally, it goes without saying that the image-forming layer coated may undergo surface treatment with a calendering apparatus, such as a machine, super or soft calender, and such surface treatment may also carried out in the stage of forming the light resistance imparting layer.

The present invention will now be illustrated in more detail by reference to the following examples, but it should be understood that these examples are not to be construed as limiting the scope of the invention in any way. Unless otherwise noted, all "parts" and all "%" are by weight in the following examples and comparative examples. The formulae of coating compositions employed for light resistance-imparting layers and image-forming layers in the following examples and comparative examples are set forth in Table 1, and evaluation results of recording materials prepared from such coating compositions are shown in Table 2.

The entire disclosure of all application, patents and publications, cited above and below, and of corresponding Japanese application No. 2000-095723, filed Mar. 30, 2000, and No. 2001-066297, filed Mar. 9, 2001, is hereby incorporated by reference.

EXAMPLE 1

A slurry was prepared by mixing 100 parts of pulp constituted of 90 weight % of hardwood bleached kraft pulp and 10 weight % of softwood bleached kraft pulp and beaten so as to have a freeness of 370 ml, 3 parts of cationic starch, 0.3 parts of anionic polyacrylamide and 0.5 parts of an alkylketene dimer emulsion, and made into paper web by means of a Fourdrinier paper machine. Successively, the paper web was subjected to 3-stage wet press first, and then 2-stage tension press in the drying section, and further dried. On the thus made paper web, a solution containing 5% of starch esterified with phosphoric acid and 0.5% of polyvinyl alcohol was coated so as to have a coverage of 3.2 g/m$^2$ (on a dry basis) by means of a size press, dried and subjected to surface treatment with a machine calender. The base paper thus prepared had a basis weight of 98 g/m$^2$. (Lower Layer: Light Resistance-imparting Layer)

To a mixture of 100 parts of synthetic amorphous silica (FINESIL X-12, produced by Tokuyama Corp.), 30 parts of polyvinyl alcohol (PVA117, produced by Kuraray Co., Ltd.), 4 parts of an ethylene-vinyl acetate emulsion (Sumikaflex 401, produced by Sumitomo Chemical Industries Co., Ltd.), 0.3 parts of a styrene-butadiene latex (NIPOL LX438C, produced by Nippon Zeon Co.), 0.3 parts of a defoaming agent (SN Defoamer), 0.005 parts of a blueing agent and 0.5 parts of a fluorescent dye, 2 parts of aluminum sulfate was added as a light resistance-imparting agent and stirred together with water as a diluent, thereby preparing a coating composition having a solids concentration of 18%.

The coating composition thus prepared was coated on the foregoing base paper so as to have a coverage of 10 g/m$^2$ (on a dry basis) by means of a bar blade coater, and dried till the water content in the coated paper as a whole was reduced to 5%. Thus, a paper having a light resistance-imparting layer as an undercoat was obtained.

Upper Layer: Image-forming Layer

A coating composition constituted of 50 parts of synthetic amorphous silica (FINESIL X-60, produced by Tokuyama Corp.), 50 parts of synthetic amorphous silica (FINESIL X-37B, produced by Tokuyama Corp.), 33 parts of polyvinyl alcohol (PVA117, produced by Kuraray Co., Ltd.), 5 parts of an ethylene-vinyl acetate emulsion (Sumikaflex 401, produced by Sumitomo Chemical Industries Co., Ltd.), 8 parts of a diallyldimethylammonium chloride-acrylamide copolymer as a dye fixer (PA-J-81, produced by Nitto Boseki Co., Ltd.), 0.3 parts of a defoaming agent (SN Defoamer), 0.01 parts of a blueing agent, 0.8 parts of a fluorescent dye, and water as a diluent in an amount required for adjusting the solids concentration to 10% was coated on the light resistance-imparting layer so as to have a coverage of 10 g/m$^2$ (on a dry basis), and dried till the water content in the thus coated paper as a whole was reduced to 5%, and further subject to a soft calendering treatment the linear pressure of 80 kg/cm. Thus, a coated paper for ink-jet recording was produced.

EXAMPLE 2

An ink jet recording paper was produced in the same manner as in Example 1, except that the coverage of the image-forming layer (upper layer) was increased to 15 g/m$^2$ (on a dry basis).

EXAMPLE 3

An ink jet recording paper was produced in the same manner as in Example 1, except that the coverage of the image-forming layer (upper layer) was decreased to 5 g/m$^2$ (on a dry basis).

EXAMPLE 4

An ink jet recording paper was produced in the same manner as in Example 2, except that the amount of aluminum sulfate added to the light resistance-imparting layer (lower layer) was increased to 5 parts.

EXAMPLE 5

An ink jet recording paper was produced in the same manner as in Example 1, except that the light-resistant chemical used in the light resistance-imparting layer (lower layer) was changed from aluminum sulfate to zinc oxide and the addition amount thereof was changed from 2 parts to 5 parts.

EXAMPLE 6

An ink jet recording paper was produced in the same manner as in Example 1, except that the light-resistant chemical used in the light resistance-imparting layer (lower layer) was changed from aluminum sulfate to an ultraviolet absorbent of benzotriazole type (Adekabusta LA-31, produced by Asahi Denka Kogyo Co., Ltd.) and the addition amount thereof was changed from 2 parts to 5 parts.

EXAMPLE 7

An ink jet recording paper was produced in the same manner as in Example 1, except that 5 parts of zinc oxide and 5 parts of an ultraviolet absorbent of benzotriazole type (Adekabusta LA-31, produced by Asahi Denka Kogyo Co., Ltd.) were added in addition to 2 parts of aluminum sulfate as light-resistant chemicals used in the light resistance-imparting layer (lower layer).

EXAMPLE 8

An ink jet recording paper was produced in the same manner as in Example 1, except that a mixture of 3 parts of zinc sulfate, 4 parts of titanium oxide and 5 parts of an ultraviolet absorbent of benzotriazole type (Adekastab LA-51, produced by Asahi Denka Kogyo Co., Ltd.) was added as light-resistant chemicals to the light resistance-imparting layer in place of 2 parts of aluminum sulfate.

COMPARATIVE EXAMPLE 1

An ink jet recording paper was prepared in the same manner as in Example 7, except that the mixture of three different light-resistant chemicals (2 parts of aluminum sulfate, 5 parts of zinc oxide and 5 parts of ultraviolet absorbent of benzotriazole type (Adekabusta LA-31, produced by Asahi Denka Kogyo Co., Ltd.) added to the light resistance-imparting layer was added also to the coating composition for the image-forming layer and the resulting composition was used for coating an image-forming layer.

COMPARATIVE EXAMPLE 2

An ink jet recording paper was prepared in the same manner as in Comparative Example 1, except that the mixture of light-resistant chemicals added to the coating composition for the image-forming layer was reduced to 5 parts of aluminum sulfate alone.

COMPARATIVE EXAMPLE 3

An ink jet recording paper was prepared in the same manner as in Comparative Example 1, except that the mixture of light-resistant chemicals added to the coating composition for the image-forming layer was reduced to 4 parts of zinc oxide alone.

COMPARATIVE EXAMPLE 4

An ink jet recording paper was prepared in the same manner as in Comparative Example 1, except that the mixture of light-resistant chemicals added to the coating composition for the image-forming layer was reduced to only 6 parts of ultraviolet absorbent of benzotriazole type (Adekabusta LA-31, produced by Asahi Denka Kogyo Co., Ltd.).

COMPARATIVE EXAMPLE 5

An ink jet recording paper was prepared in the same manner as in Comparative Example 1, except that the mixture of three different light-resistant chemicals added to the image-forming layer was not added to the lower layer (namely, the lower layer was free of all light-resistant chemicals).

Evaluation Methods

Evaluations of recording papers produced in Examples and Comparative Examples were made in accordance with the following criteria. For printing images on the recording papers each, an ink-jet printer, Model PM-700 (trade name, a product of Seiko Epson Corp.), was used. The printed images were examined for color reproduction (densities of color images printed), ink absorbency and bronze luster, and how close the images printed were to images of photograph style was judged by examination results of those characteristics.

(i) Color Reproduction:

Black, cyan, magenta and yellow solid images formed with the aid of EXCEl (as a softwear of calculations for tabulation) were printed on each recording paper, and the density of each color image was measured with a reflection densitometer, Model RD914 (made by Macbeth Co., Ltd.). The color reproduction was evaluated by the sum total of measured values of those color densities.

◎: Sum total of measured values is 6 or above.

○: Sum total of measured values is at least 5 but below 6.

Δ: Sum total of measured values is at least 4 but below 5.

X: Sum total of measured values is below 4.

(ii) Ink Absorption:

The ink absorption is examined by printing, on each recording paper, a checkered pattern of red and green solid images formed with the aid of EXCEl, and carrying out visual observation of the extent of bleeding at the red-green boundary, and evaluated according to the following criteria.

◎: The boundary is clear and free of bleeding.

○: Almost no bleeding is observed at the boundary.

Δ: Some bleeding is observed at the boundary.

X: Marked bleeding is observed at the boundary.

(iii) Bronze Luster:

Black solid images formed with the aid of EXCEL were printed on each recording paper, and observed visually at an angle of about 30 to 60 degrees. And the extent to which the images took on a bronze luster was judged according to the following criteria:

◎: No bronze luster is observed.

○: A little bronze luster is observed.

Δ: Bronze luster is observed on at least half of image areas.

X: Bronze luster is observed over almost all image areas.

(iv) Coming-off in Powder:

An A4-size sheet of each recording paper was cut 20 times along the width direction by means of an NT cutter, and the paper dust produced thereby was gathered and the weight thereof was measured. The tendency of the coatings to come off in powder was evaluated according to the following criteria:

◎: Paper dust gathered has a weight of below 5 mg

○: Paper dust gathered has a weight of from 5 mg to below 10 mg

Δ: Paper dust gathered has a weight of from 10 mg to below 30 mg

X: Paper dust gathered has a weight of 30 mg or above (v) Light Resistance of Printed Images:

The black, cyan, magenta and yellow solid images formed with the aid of EXCEL were each printed on each recording paper, and exposed to light for 25 hours by the use of a Xenon Weather Meter. Therein, each color densities before and after the exposure were measured, and the rate of residual density of each printed image was calculated. The light resistance was evaluated by an average of the density remaining rates of 4 color images. The criteria adopted therefor are as follows:

[Remaining rate (%)=Density of printed image after exposure×100/density thereof before exposure]

◎: The remaining rate is at least 80%.

○: The remaining rate is at least 60% but lower than 80%.

Δ: The remaining rate is at least 40% but lower than 60%.

X: The remaining rate is lower than 40%.

(vi) Water Resistance of Printed Images:

The black, cyan, magenta and yellow solid images formed with the aid of EXCEL were each printed on each recording paper, and allowed to stand for 1 day. Then, each recording paper was examined for image density of each color. Further, the recording paper was immersed in 25° C. ion exchange water for 10 minutes, and dried for 3 minutes at 60° C. by means of an air-blower. Thereafter, the densities of the thus treated color images were each measured, and the rate of residual density of each printed image was calculated. The water resistance was evaluated by an average of the density remaining rates of 4 color images. The criteria adopted therefor are as follows:

[Remaining rate (%)=Density of printed image after immersion×100/density thereof before immersion]

◎: The remaining rate is at least 80%.

○: The remaining rate is at least 60% but lower than 80%.

Δ: The remaining rate is at least 40% but lower than 60%.

X: The remaining rate is lower than 40%.

TABLE 1

| | | Coverage | Formula of Coating Compositions | | | | | | |
|---|---|---|---|---|---|---|---|---|---|
| | | | Dye fixer | Metal salt | | Inorganic UV absorbent | | Organic UV absorbent | |
| | | g/m$^2$ | parts | species | parts | species | parts | species | parts |
| Example 1 | lower layer | 10 | 5 | Aluminum sulfate | 2 | not added | — | not added | — |
| | upper layer | 10 | 8 | not added | — | not added | — | not added | — |
| Example 2 | lower layer | 10 | 5 | Aluminum sulfate | 2 | not added | — | not added | — |
| | upper layer | 15 | 8 | not added | — | not added | — | not added | — |
| Example 3 | lower layer | 10 | 5 | Aluminum sulfate | 2 | not added | — | not added | — |
| | upper layer | 5 | 8 | not added | — | not added | — | not added | — |
| Example 4 | lower layer | 10 | 5 | Aluminum sulfate | 5 | not added | — | not added | — |
| | upper layer | 15 | 8 | not added | — | not added | — | not added | — |
| Example 5 | lower layer | 10 | 5 | not added | — | Zinc oxide | 5 | not added | — |
| | upper layer | 10 | 8 | not added | — | not added | — | not added | — |
| Example 6 | lower layer | 10 | 5 | not added | — | not added | — | Benzotriazole | 5 |
| | upper layer | 10 | 8 | not added | — | not added | — | not added | — |
| Example 7 | lower layer | 10 | 5 | Aluminum sulfate | 2 | Zinc oxide | 5 | Benzotriazole | 5 |
| | upper layer | 10 | 8 | not added | — | not added | — | not added | — |
| Example 8 | lower layer | 10 | 5 | Zinc sulfate | 3 | Titanium dioxide | 4 | Benzophenone | 5 |
| | upper layer | 10 | 8 | not added | — | not added | — | not added | — |
| Compar. Ex. 1 | lower layer | 10 | 5 | Aluminum sulfate | 2 | Zinc oxide | 5 | Benzotriazole | 5 |
| | upper layer | 10 | 8 | Aluminum sulfate | 2 | Zinc oxide | 5 | Benzotrizole | 5 |
| Compar. Ex. 2 | lower layer | 10 | 5 | Aluminum sulfate | 2 | Zinc oxide | 5 | Benzotriazole | 5 |
| | upper layer | 10 | 8 | Aluminum sulfate | 5 | not added | — | not added | — |
| Compar. Ex. 3 | lower layer | 10 | 5 | Aluminum sulfate | 2 | Zinc oxide | 5 | Benzotriazole | 5 |
| | upper layer | 10 | 8 | not added | — | Zinc oxide | 4 | not added | — |
| Compar. Ex. 4 | lower layer | 10 | 5 | Aluminum sulfate | 2 | Zinc oxide | 5 | Benzotriazole | 5 |
| | upper layer | 10 | 8 | not added | — | not added | — | Benzotriazole | 6 |
| Compar. Ex. 5 | lower layer | 10 | 5 | not added | — | not added | — | not added | — |
| | upper layer | 10 | 8 | Aluminum sulfate | 2 | Zinc oxide | 5 | Benzotriazole | 5 |

TABLE 2

| | Color reproduction | Ink absorption | Bronze Luster | Coming-off in powder | Light resistance | Water resistance |
|---|---|---|---|---|---|---|
| Example 1 | ◎ | ○ | ◎ | ◎ | ○ | ◎ |
| Example 2 | ◎ | ◎ | ◎ | ○ | ○ | ◎ |
| Example 3 | ○ | ○ | ◎ | ◎ | ○ | ◎ |
| Example 4 | ◎ | ◎ | ○ | ○ | ◎ | ◎ |
| Example 5 | ◎ | ○ | ◎ | ◎ | ◎ | ◎ |
| Example 6 | ◎ | ○ | ◎ | ◎ | ○ | ◎ |
| Example 7 | ○ | ○ | ◎ | ◎ | ◎ | ◎ |
| Example 8 | ○ | ○ | ◎ | ◎ | ◎ | ◎ |
| Compar.Ex.1 | X | X | X | ○ | ◎ | ○ |
| Compar.Ex.2 | Δ | ○ | X | ○ | ◎ | ○ |
| Compar.Ex.3 | X | Δ | ○ | ○ | ○ | ○ |
| Compar.Ex.4 | X | Δ | ○ | ○ | ○ | ○ |
| Compar.Ex.5 | X | X | X | ○ | ○ | Δ |

As can be seen from Table 1 and Table 2, the recording papers prepared in Examples, wherein light-resistant chemicals were contained in the light resistance-imparting layer alone but not contained in the image-forming layer, attained printed image density-remaining rates of at least 60% and water resistance of at least 80%, showed satisfactory color reproduction and ink absorption, and besides, they were almost free of bronze luster. In other words, the recording papers according to the invention were successful in reproducing images of photographic style. On the other hand, the comparative recording papers containing light-resistant chemicals in their image-forming layers, though the light resistance thereof was on a practical level, were inferior in color image densities and ink absorption, and what is worse, the color images printed thereon took on bronze luster. Therefore, the images printed on the comparative recording papers were far from images of photographic style. Further, it was discovered that the absence of light-resistant chemicals in an image-forming layer enabled an improvement in water resistance of printed images.

In accordance with the invention, therefore, color images printed on recording paper can have improved water resistance as well as light resistance, and be protected effectively from density drop and discoloration.

What is claimed is:

1. A recording material for ink-jet recording, comprising a support coated, in the following order, with:

a light resistance-imparting layer containing a light resistance-imparting chemical, and an image-forming layer containing at least one pigment selected from the group consisting of amorphous silica, alumina, hydrated alumina, aluminum silicate, magnesium silicate, magnesium carbonate, precipitated calcium carbonate, ground calcium carbonate, kaolin, talc, calcium sulfate, zinc carbonate, calcium silicate aluminum hydroxide and a plastic pigment, but free of a light resistance-imparting chemical, wherein the image-forming layer and the light resistance-imparting layer both contain pigments such that the average oil absorption of the pigment(s) in the image-forming layer is higher than the average oil absorption of the pigment(s) in the light resistance-imparting layer.

2. A recording material for ink-jet recording as described in claim 1, wherein the light resistance-imparting layer has a coverage of 5 to 20 g/m$^2$ on a dry basis and the image-forming layer has a coverage of 4 to 20 g/m$^2$ on a dry basis.

3. A recording material for ink-jet recording as described in claim 1, wherein the light resistance-imparting chemical is at least one chemical selected from the group consisting of inorganic ultraviolet absorbents, organic ultraviolet absorbents and divalent or higher metal salts and has a content of from 0.5 to 20 parts by weight when it is an inorganic ultraviolet absorbent, from 0.5 to 15 parts when it is an organic ultraviolet absorbent, or from 0.5 to 10 parts by weight when it is a divalent or higher metal salt, per 100 parts by weight of pigments contained in the light resistance-imparting layer.

4. A recording material for inkjet recording as described in claim 3, wherein the at least one light resistance-imparting chemical is an organic ultraviolet absorbent which is a hindered amine, a benzotriazole or a benzophenone.

5. A recording material for ink-jet recording as described in claim 3, wherein the at least one light resistance-imparting chemical is an inorganic ultraviolet absorbent which is zinc oxide, titanium oxide or cerium oxide.

6. A recording material for ink-jet recording as described in claim 3, wherein the at least one light resistance-imparting chemical is a divalent or higher metal salt which is aluminum sulfate, zinc sulfate or copper sulfate.

7. A recording material for ink-jet recording of claim 1, wherein the image-forming layer comprises the recited pigment, a binder suitable for the pigment used, and a cationic high polymer which provides dye fixation and improved water resistance.

8. A recording material for inkjet recording of claim 1, wherein the light resistance-imparting layer contains, in addition to the light resistance-imparting chemical, a highly an oil-absorptive pigment and a binder suitable for the pigment.

9. A recording material for ink-jet recording of claim 1, wherein the light resistance-imparting layer has a coverage of 7 to 15 $g/m^2$ on a dry basis and the image-forming layer has a coverage of 5 to 15 $g/m^2$ on a dry basis.

10. A recording material for ink-jet recording of claim 1, wherein the recording material further comprises an interlayer containing no light resistance-imparting chemicals between the support and the light resistance-imparting layer.

11. A recording material for inkjet recording of claim 1, wherein the light resistance-imparting chemical includes each of at least one inorganic ultraviolet absorbent, at least one organic ultraviolet absorbent and at least one divalent or higher metal salt wherein the total amount of light-resistant chemicals is from 0.5 to 30 parts by weight per 100 parts by weight of pigments in the light resistance-imparting layer.

12. A recording material for ink-jet recording of claim 1, wherein the image-forming layer and the light resistance-imparting layer both contain pigments such that the average oil absorption of the pigments is each layer is from 100 to 300 cc/100 g.

* * * * *

UNITED STATES PATENT AND TRADEMARK OFFICE

CERTIFICATE OF CORRECTION

PATENT NO. : 6,652,931 B1
DATED : November 25, 2003
INVENTOR(S) : Teiichi Otani et al.

It is certified that error appears in the above-identified patent and that said Letters Patent is hereby corrected as shown below:

Column 13,
Line 20, delete “a highly”

Signed and Sealed this

Seventh Day of September, 2004

JON W. DUDAS
*Director of the United States Patent and Trademark Office*